US010591184B2

(12) United States Patent
La Porte

(10) Patent No.: US 10,591,184 B2
(45) Date of Patent: Mar. 17, 2020

(54) APPARATUSES AND METHODS FOR SUPPLYING NATURAL GAS TO A FRAC WATER HEATER

(71) Applicant: Force Energy Management Corporation, Fort St. John (CA)

(72) Inventor: Christopher La Porte, Charlie Lake (CA)

(73) Assignee: 1026844 B.C. Ltd., Kamloops (CA)

( * ) Notice: Subject to any disclaimer, the term of this patent is extended or adjusted under 35 U.S.C. 154(b) by 353 days.

(21) Appl. No.: 14/897,820

(22) PCT Filed: Jun. 10, 2014

(86) PCT No.: PCT/CA2014/000487
§ 371 (c)(1),
(2) Date: Dec. 11, 2015

(87) PCT Pub. No.: WO2014/197969
PCT Pub. Date: Dec. 18, 2014

(65) Prior Publication Data

US 2016/0138826 A1 May 19, 2016

Related U.S. Application Data

(60) Provisional application No. 61/834,783, filed on Jun. 13, 2013.

(30) Foreign Application Priority Data

May 12, 2014 (CA) ..... 2851304

(51) Int. Cl.
*F24H 1/20* (2006.01)
*F24H 1/06* (2006.01)
(Continued)

(52) U.S. Cl.
CPC ..... *F24H 1/20* (2013.01); *E21B 43/26* (2013.01); *F24H 1/06* (2013.01); *F24H 1/186* (2013.01); *F24H 9/1809* (2013.01)

(58) Field of Classification Search
CPC ..... F24H 1/20; F24H 9/1809; E21B 43/26
See application file for complete search history.

(56) References Cited

U.S. PATENT DOCUMENTS 3,106,915 A 10/1963 Key, Jr.
3,254,711 A 6/1966 Parker
(Continued)

FOREIGN PATENT DOCUMENTS

CA 1 294 564 A1 1/1992
CA 2079536 A1 2/1994
(Continued)

OTHER PUBLICATIONS

Hyer, G., Your Energy Management Partner, 2013 Williston Basin Petroleum Conference, Canada, May 2, 2013, p. 1-12.
(Continued)

*Primary Examiner* — Nathaniel Herzfeld
(74) *Attorney, Agent, or Firm* — Christensen O'Connor Johnson Kindness PLLC

(57) ABSTRACT

Apparatuses and methods for heating well fracturing fluid using natural gas supplied to a frac water heater are provided. In some embodiments, portable separators can be tied into an existing, on-site, natural gas source and supply the heating unit's burner system with the producer's own produced natural gas (for example, sweet fuel gas). By using on-site sweet fuel gas, liquefied petroleum gas (LPG) or diesel consumption and associated cartage costs can be reduced or eliminated. As such, the apparatuses and methods can also reduce the associated carbon footprint on the environment. In some embodiments, the apparatuses and
(Continued)

methods can comprise a drying element to dry or condition the gas prior to use.

14 Claims, 7 Drawing Sheets

(51) Int. Cl.
*F24H 1/18* (2006.01)
*E21B 43/26* (2006.01)
*F24H 9/18* (2006.01)

(56) References Cited

U.S. PATENT DOCUMENTS 3,401,673 A 9/1968 Key, Jr.
4,235,325 A 11/1980 Miller
4,421,062 A * 12/1983 Padilla, Sr. ..... F24H 1/00 122/1 R
4,455,157 A * 6/1984 Honerkamp ..... B01D 53/263 261/114.2
4,479,546 A * 10/1984 Bresie ..... E21B 43/00 166/267
4,597,437 A * 7/1986 McNabb ..... E21B 43/34 166/79.1
4,689,053 A * 8/1987 Heath ..... B01D 53/263 165/300
4,701,188 A * 10/1987 Mims ..... B01D 53/263 95/18
4,779,677 A 10/1988 Cobb
5,042,582 A 8/1991 Rajewski
5,132,011 A * 7/1992 Ferris ..... B01D 19/0042 210/187
5,163,981 A * 11/1992 Choi ..... B01D 53/263 95/209
5,453,114 A * 9/1995 Ebeling ..... B01D 53/263 95/166
5,656,136 A 8/1997 Gayaut et al.
5,797,561 A 8/1998 Madrzak
5,900,137 A * 5/1999 Homan ..... B01D 17/005 175/206
6,063,163 A * 5/2000 Carmody ..... B01D 53/263 95/187
6,955,704 B1 10/2005 Strahan
6,962,199 B1 11/2005 Willink
7,219,500 B1 5/2007 Rhodes
7,520,743 B1 * 4/2009 Roberts ..... E21B 43/34 196/46
7,575,672 B1 * 8/2009 Gilmore ..... B01D 17/0211 210/117
8,312,924 B2 11/2012 Smith
2003/0225169 A1 * 12/2003 Yetman ..... C01B 3/34 518/726
2006/0065400 A1 3/2006 Smith
2006/0162942 A1 7/2006 Blevins et al.
2007/0056726 A1 * 3/2007 Shurtleff ..... E21B 43/24 166/245
2007/0246401 A1 * 10/2007 Al-Faqeer ..... B01D 53/002 208/251 R
2009/0029303 A1 1/2009 Wiggins
2010/0065267 A1 3/2010 Lantz
2010/0071899 A1 3/2010 Coquilleau et al.
2010/0242732 A1 9/2010 Saville
2010/0294494 A1 * 11/2010 Hefley ..... E21B 43/26 166/272.2
2011/0094385 A1 4/2011 Gates
2011/0211818 A1 9/2011 Grady
2012/0152531 A1 * 6/2012 Cerenzie ..... E21B 43/26 166/250.01
2012/0325751 A1 * 12/2012 Renick ..... E21B 43/26 210/739

FOREIGN PATENT DOCUMENTS

CA 2468012 A1 11/2004
CA 2 499 699 A1 3/2006
CA 2546315 A1 11/2006
CA 2570719 A1 6/2008
CA 2633332 A1 12/2008
CA 2 671 043 A1 1/2010
CA 2754347 A1 3/2011
CA 2 706 399 A1 11/2011
CA 2723639 A1 5/2012
CA 2728035 A1 6/2012
CA 2762244 A1 8/2012
CA 2773843 A1 10/2012

OTHER PUBLICATIONS

First Canadian Office Action dated Sep. 30, 2014, issued in corresponding Canadian Patent No. 2851304, 2 pages.
Second Canadian Office Action dated Dec. 4 2014, issued in corresponding Canadian Patent No. 2851304, 4 pages.
Third Canadian Office Action dated Mar. 20, 2015, issued in corresponding Canadian Patent No. 2851304, 3 pages.
Fourth Canadian Office Action dated Jul. 7, 2015, issued in corresponding Canadian Patent No. 2851304, 3 pages.
International Search Report and Written Opinion, dated Sep. 17, 2014, issued in corresponding International Application No. PCT/CA2014/000487, filed Jun. 10, 2014, 9 pages.
International Preliminary Report on Patentability, dated Dec. 23, 2015, issued in corresponding International Application No. PCT/CA2014/000487, filed Jun. 10, 2014, 7 pages.
Statement of Claim in Court of Queen's Bench of Alberta Court No. 1403-13171, *Force Energy Management Corporation* v. *Delphi Energy Corp.*, filed on Sep. 11, 2014, 4 pages.
Statement of Defence in Court of Queen's Bench of Alberta Court No. 1403-13171, *Force Energy Management Corporation* v. *Delphi Energy Corp.*, filed on Oct. 24, 2014, 4 pages.
Amended Statement of Claim in Court of Queen's Bench of Alberta Court No. 1403-13171, *Force Energy Management Corporation and 1026844 B.C. Ltd.*, v. *Delphi Energy Corp.*, filed on Jul. 15, 2016, 5 pages.
Amended Statement of Defence in Court of Queen's Bench of Alberta Court No. 1403-13171, *Force Energy Management Corporation and 1026844 B.C. Ltd.*, v. *Delphi Energy Corp.*, filed on Aug. 11, 2016, 14 pages.
Statement of Claim in Federal Court of Canada No. T-1411-16, *Delphi Energy Corp.* v. *0645148 B.C. Ltd. and 1026844 B.C. Ltd.*, filed on Aug. 23, 2016, 50 pages.
Statement of Defence in Federal Court of Canada No. T-1411-16, *Delphi Energy Corp.* v. *0645148 B.C. Ltd. and 1026844 B.C. Ltd.*, filed on Oct. 5, 2016, 5 pages.
"Treater-Combo," Engineered Concepts, LLC, Oct. 31, 2017, 3-page brochure.
"New Oil and Gas Production System Design Slashes Installation Time and Costs," Engineered Concepts, LLC, Houston, Texas, Aug. 8, 2012, 4 pages.
"E&P and Midstream Process Equipment and Capabilities," Engineered Concepts, LLC, Oct. 31, 2017, 12-page brochure.
"Production Solutions: Horizontal Treater," Exterran Holdings, Inc., Houston, Texas, 2015, 2-page brochure.
"Flow Solutions Guide: Vertical Heater Treater Optimization," Emerson Process Management Inc., 2014, 4-page brochure.

* cited by examiner

APPARATUSES AND METHODS FOR SUPPLYING NATURAL GAS TO A FRAC WATER HEATER

CROSS REFERENCE TO RELATED APPLICATIONS

This application claims priority of U.S. provisional patent application Ser. No. 61/834,783 filed Jun. 13, 2013, and Canadian patent application serial no. 2,851,304 filed May 12, 2014, both of which are incorporated by reference herein in their entirety.

TECHNICAL FIELD

The present disclosure is related to the field of apparatuses and methods for heating a fluid, in particular, apparatuses and methods for heating well fracturing fluid using dried or conditioned natural gas supplied to a frac water-heater's burner system.

BACKGROUND

It is known to use tank containments and heating equipment to store, heat, and separate fluids, such as hydraulic well fracturing (fracing) fluid, water, and others, to be used for well fracturing applications. This storage and heating is often done on a lease site, although the tank containments and heating equipment can be portable. It would be understood by one skilled in the art, and known in the prior art, that a single site can include a geographical location where a number of oil extraction facilities and related equipment are present, along with natural gas extraction surface production facilities, which are designed to capture or contain natural gas. It would be understood by one skilled in the art, and known in the prior art, that a single site can include, using the terminology of the Dominion Land Survey system used in Western Canada, a number of nearby legal subdivisions within the same township or adjacent townships, where fuel is required to be brought in by truck, or other vehicular transport, from a different site.

Existing frac water heating units consume large amounts of fuel (for example, propane or diesel) utilized in the burner system to heat large amounts of water for the use in the well hydraulic fracturing process. This in turn, can incur great expense to the oil and gas companies in the purchase and cartage of the diesel and propane fuel source in the heating process. In addition, this also results in an undesired, increased, carbon footprint.

Super Heaters™ and hot oil units, as are known in the art, can cost producers $15,000 to $20,000 per day or more in liquefied petroleum gas (LPG) and/or diesel consumption and cartage costs.

Accordingly, there is a need to provide apparatuses and methods for heating an on-site fluid that can overcome the short-comings of the prior art, in particular to ameliorate the need to purchase and transport large amounts of propane or diesel used to supply fuel to the frac water heating units and to save oil and gas companies up to $20,000 per day.

SUMMARY

Apparatuses and methods for heating well fracturing fluid using natural gas supplied to a frac water heater are provided. In some embodiments, portable separators can be tied into an existing, on-site, natural gas source and supply the heating unit's burner system with the producer's own produced natural gas (for example, sweet fuel gas). By using on-site sweet fuel gas, liquefied petroleum gas (LPG) or diesel consumption and associated cartage costs can be reduced or eliminated. As such, the apparatuses and methods can also reduce the associated carbon footprint on the environment. In some embodiments, the apparatuses and methods can comprise a drying element to dry or condition the gas prior to use.

The designed apparatuses and methods can allow the oil and gas company to reduce or eliminate the need to incur the expenses associated with purchase and cartage of vast amounts of propane and diesel by using their own produced natural gas to supply the frac water heating unit's burner system. As such, an oil and gas company can significantly reduce the daily costs associated with heating well fracturing fluid as well as reduce their carbon footprint on the environment.

In some embodiments, the natural gas supply can be "dry" or conditioned after running through a drying or conditioning process prior to be being used as a fuel source in the frac water heating unit's burner system for a more cost effective fuel source.

It can be noted that the term fluid could be any fluid (liquid, gas, or otherwise) requiring heating or stabilization of temperature, for example but not limited to, water, air, liquid solutions, fracing fluid, oil, water/oil emulsions, etc., and in some cases, can be a sludge, slush, slurry, or composite of solid/liquid/gas.

It can be noted that the terms line(s) or piping as used throughout can mean a fluid connection and can encompass any means, as understood by one skilled in the art, which can provide a fluid connection as the context requires.

It can be noted that the terms processing or processed as used throughout can mean separating, drying, conditioning or separated, dried/dry, conditioned and can encompass any means, as understood by one skilled in the art, which can provide the processing as the context requires.

Broadly stated, in some embodiments, an apparatus is provided for heating a stored on-site fluid, comprising an inlet to receive natural gas from an on-site source and to provide the natural gas to a separator, a separator to process the natural gas, the separator in-line with the inlet, and an outlet from the separator to supply the processed gas from the separator to a burner.

In some embodiments, the apparatus can further comprise a dryer configured to dry the natural gas prior to supplying the processed gas to the burner. In some embodiments, the apparatus can further comprise a conditioner configured to condition the natural gas prior to supplying the processed gas to the burner.

In some embodiments, the apparatus can further be configured to be mobile. In some embodiments, the apparatus can further comprise a means for towing the apparatus.

In some embodiments, the separator can be a separator package. In some embodiments, the apparatus can further comprise a base to support the separator. In some embodiments, the apparatus can further comprise an enclosure to enclose the separator. In some embodiments, the enclosure can be insulated. In some embodiments, the enclosure can define an entry way for an operator to access the separator. In some embodiments, the enclosure can define at least one window for an operator to view the separator.

In some embodiments, the apparatus can further comprise an electronics system connection in communication with the separator, the electronics system configured to operate the separator. In some embodiments the electronics system can be selected from the group consisting of a knowledge box, laptop, tablet, smart phone, and measuring devices.

Broadly stated, in some embodiments, a method is provided for heating a stored on-site fluid, the method comprising: providing natural gas from an on-site source to a burner; igniting the burner; fueling the burner with the natural gas to produce heat; and using the produced heat to heat the stored on-site fluid.

In some embodiments, the method can further comprise the step of separating the natural gas prior to providing it to the burner. In some embodiments, the method can further comprise the step of drying the natural gas prior to supplying it to the burner. In some embodiments, the method can further comprise the step of conditioning the natural gas prior to supplying it to the burner.

In some embodiments, the method can comprise wherein the separating and the drying steps are accomplished by an apparatus for heating a stored on-site fluid, comprising an inlet to receive natural gas from an on-site source and to provide the natural gas to a separator, a separator to process the natural gas, the separator in-line with the inlet, and an outlet from the separator to supply the processed gas from the separator to a burner.

In some embodiments, the method can further comprise the step of returning liquids separated from the natural gas during the separation step to a flow line. In some embodiments, the method can further comprise the step of heating the stored on-site fluid to a predetermined temperature. In some embodiments, the method can further comprise the step of maintaining the temperature of the stored on-site fluid at a predetermined temperature.

Broadly stated, in some embodiments, a heating system is provided for heating a stored on-site fluid, the system comprising: an apparatus for heating a stored on-site fluid, comprising an inlet to receive natural gas from an on-site source and to provide the natural gas to a separator, a separator to process the natural gas, the separator in-line with the inlet, and an outlet from the separator to supply the processed gas from the separator to a burner, the apparatus being in-line with an on-site natural gas source and a burner for heating the stored on-site fluid.

In some embodiments, the system can further comprise a fluid storage tank or containment for storing the stored on-site fluid, the fluid storage tank attached to a frac water heater through lines or hoses. In some embodiments, the system can be configured to be fluidly continuous and uninterrupted.

Broadly stated, in some embodiments, a use of a separator package is provided for processing natural gas from an on-site source and supplying it to a frac water heater burner system to heat a stored on-site fluid.

Broadly stated, in some embodiments, a use of a separator package is provided for processing natural gas from an on-site source and supplying it to a burner system of a hydraulic fracture fluid heater.

DETAILED DESCRIPTION OF EMBODIMENTS

Apparatuses and methods for heating well fracturing fluid using natural gas supplied to a frac water heater are provided. In some embodiments, portable separators can be tied into an existing, on-site, natural gas source and supply the heating unit's burner system with the producer's own produced natural gas (for example, sweet fuel gas). By using on-site sweet fuel gas, liquefied petroleum gas (LPG) or diesel consumption and associated cartage costs can be reduced or eliminated. As such, the apparatuses and methods can also reduce the associated carbon footprint on the environment. In some embodiments, the apparatuses and methods can comprise a drying element to dry or condition the gas prior to use.

In some embodiments, the apparatus can comprise (or be retrofit to, in some cases) mobile one ton towable, portable separator packages (mobile separator units), significantly reducing costs associated with heating well fracturing fluids. In some embodiments, the separator unit can be a one ton towable, bumper pull, tandem axle, inline portable test separator. In some embodiments, mobile separator units can be placed on skids or have skids attached in order to facilitate transportation.

Figure 1:
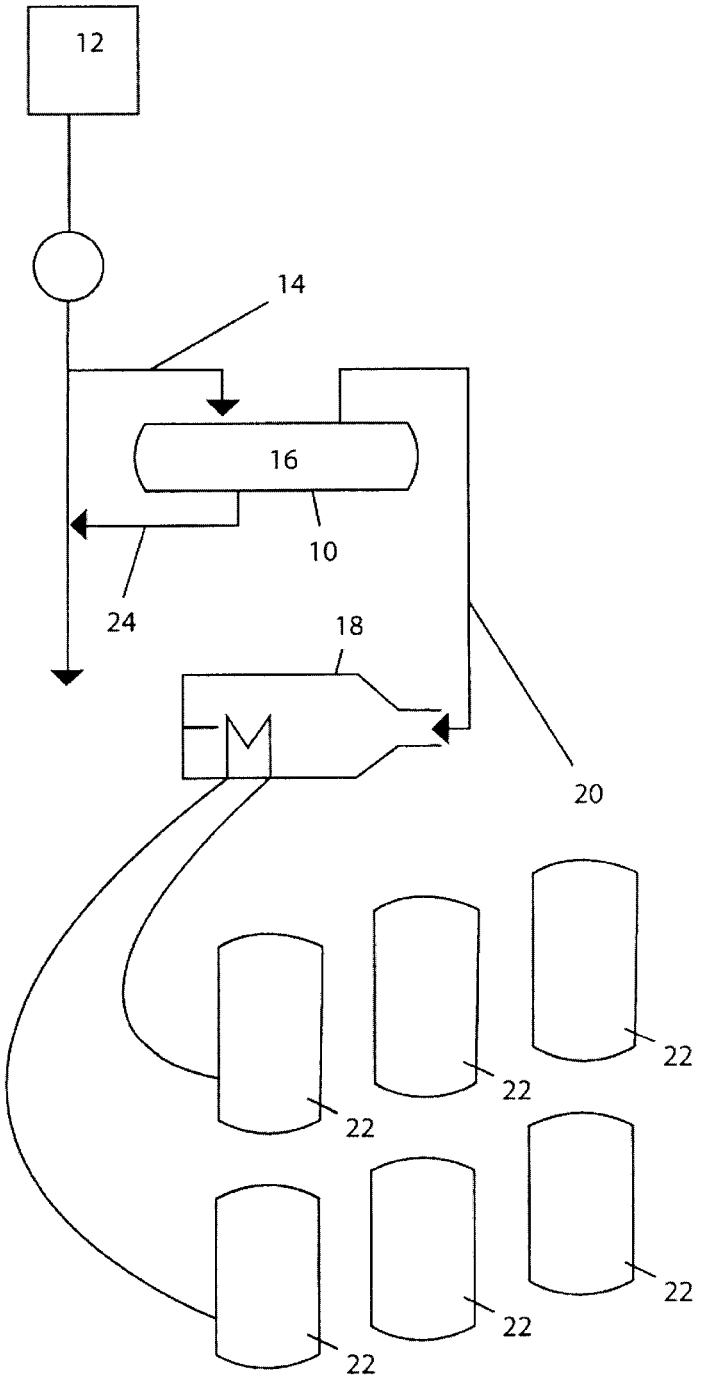
FIG. 1 is a schematic diagram of a top plan view of depicting an embodiment of a system and apparatus for heating a fluid.

Referring now to FIG. 1, a heating apparatus 18 is shown. One skilled in the art may refer to heating apparatus 18 as a frac water heater or hot oiler fuel supply unit, a frac water heater or hot oiler natural gas skid, a frac water heater fuel supply unit, a frac water heater fuel supply skid, a portable frac water heater supply unit, a mobile frac water heater natural gas unit, and/or a Super Heater™. An apparatus 10 for supplying dried or conditioned natural gas to heating apparatus 18 is provided. One skilled in the art may refer to apparatus 10 as a natural gas supply unit or skid, a well fracturing support unit or skid, an eco-friendly well fracturing support, and/or a frac water heater support unit.

An on-site gas source 12, such as a well, wellhead, or pipeline can provide gas through a first line 14 to a separator package 16. In some embodiments, the gas can be dried or conditioned before it is supplied to a frac water heater or heater unit burner 18 (such as a Super Heater™ unit burner) through second flow line 20 to be burned to heat fracing fluid 22 in storage tanks or containment to store fluid. In some embodiments, liquids captured in the system can be returned to the main flow line by a third flow line 24. Fluids and gas can be provide, supplied, transported, etc. by hoses, lines, piping, or otherwise, as known in the art and appropriate for the application.

In some embodiments, second flow line 20 can be a two inch diameter hose reel supply line and/or two inch diameter steel line and can be referred to as a natural gas carrier, a natural gas soft or hard line, a natural gas supply line/leg, a natural gas surface line, and/or a dry gas line.

In some embodiments, the system can be continuous and uninterrupted from on-site natural gas source 12 to fracing fluid 22, meaning that no additional modules, units, or functions are in-line with the system or otherwise performed aside from those provided by the system.

Figure 2:
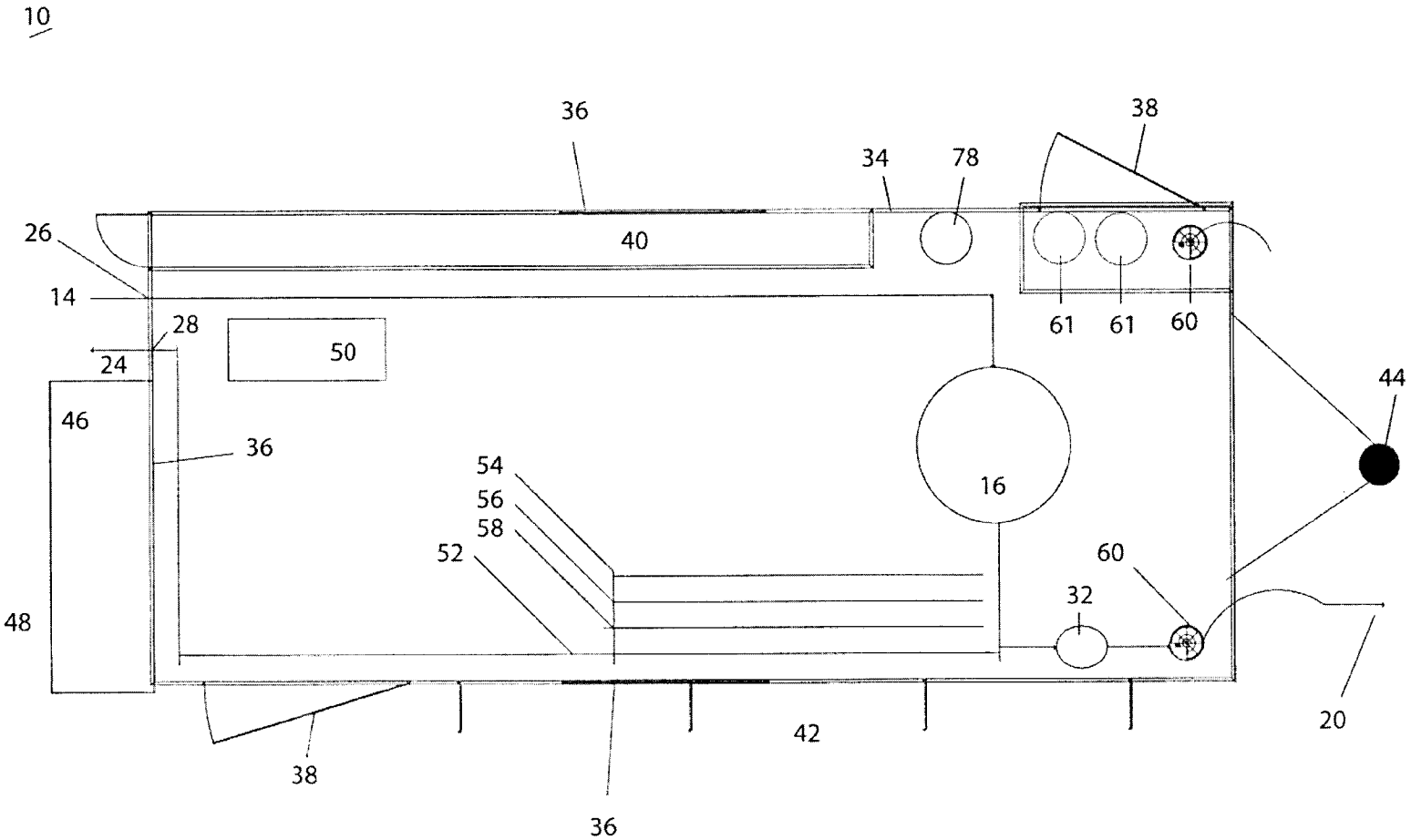
FIG. 2 is a schematic diagram of a close-up, cut-away, top plan view depicting the embodiment of an apparatus from FIG. 1.

Referring now to FIG. 2, a close-up plan view is shown, depicting the embodiment of an apparatus 10 from the system of FIG. 1. In some embodiments, apparatus 10 can comprise a natural gas supply inlet 26 to bring in natural gas from first flow line 14 and an outlet 28 to return liquids captured in the system to the main flow line by third flow line 24. Dry/conditioned gas outlet can provide dried or conditioned natural gas from apparatus 10 through second flow line 20 to burner 18. Separator 16 can be located within apparatus 10 and can separate incoming natural gas. In some embodiments, the separated natural gas can also be processed by natural gas drying or conditioning system 32. A combined fluid drain line 52 can carry combined fluids from the three drain lines: manual drain 54, water drain 56, and condensate drain 58, to the outlet 28.

In some embodiments, apparatus 10 can be enclosed/encased by enclosure 34 which can be insulated, for example by insulted walls and/or floors. Enclosure 34 can include window(s) 36 and door(s) 38 for an operator to use. Apparatus 10 can also include storage capabilities both inside and outside of enclosure 24, for example high pressure hose storage 40 and/or pipe rack 42. Apparatus 10 can also include hose reels 60 and LPG tank(s) 61 (for example, 100# LPG tank(s)) tied into fuel gas to supply LPG fuel gas if required.

In some embodiments, apparatus 10 can be configured to be mobile, portable, and/or skid mounted and can include a towing means 44 such that apparatus 10 can be towed by a motor vehicle and moved to a predetermined location.

In some embodiments, apparatus 10 can also comprise an operator office 46 with a work ledge 48 and a knowledge box 50 for setting/monitoring/calibrating/maintaining the function of apparatus 10.

In some embodiments, dimensions of apparatus 10 can be: building length 10'×width 8'6"×overall length including reach 19', although it would be understood that the dimensions can be varied without departing from the function of the apparatus and method.

Figure 3:
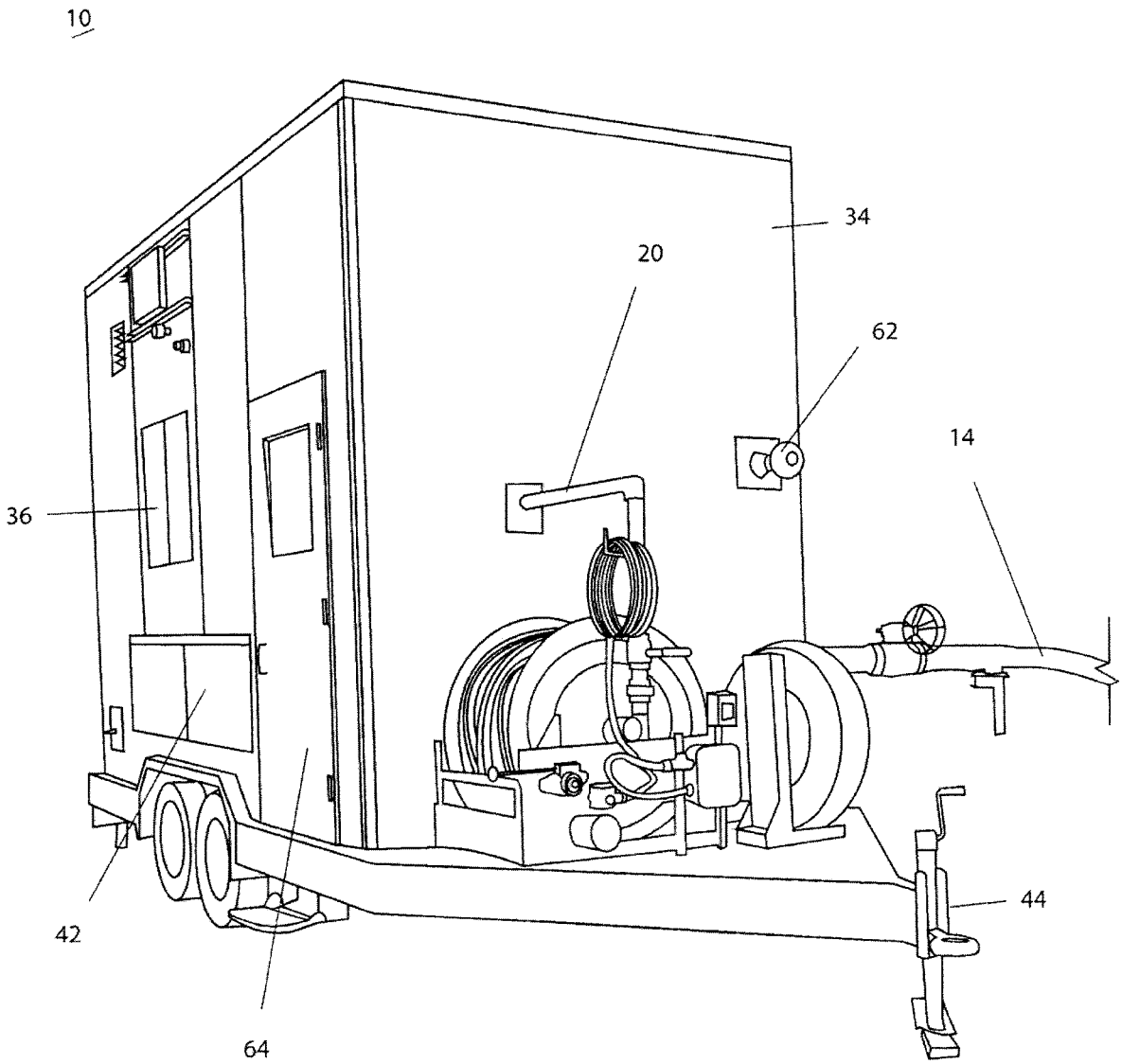
FIG. 3 is an external perspective view of an embodiment of an apparatus for supplying dried or conditioned natural gas to an apparatus for heating a fluid.

Referring to FIG. 3, an embodiment of apparatus 10 is shown. In some embodiments, apparatus 10 can also comprise a heater exhaust vent 62 extending out from enclosure 34. In some embodiments, apparatus 10 can also comprise a front entry 64 for an operator to access gas drying or conditioning system 32.

Figure 4:
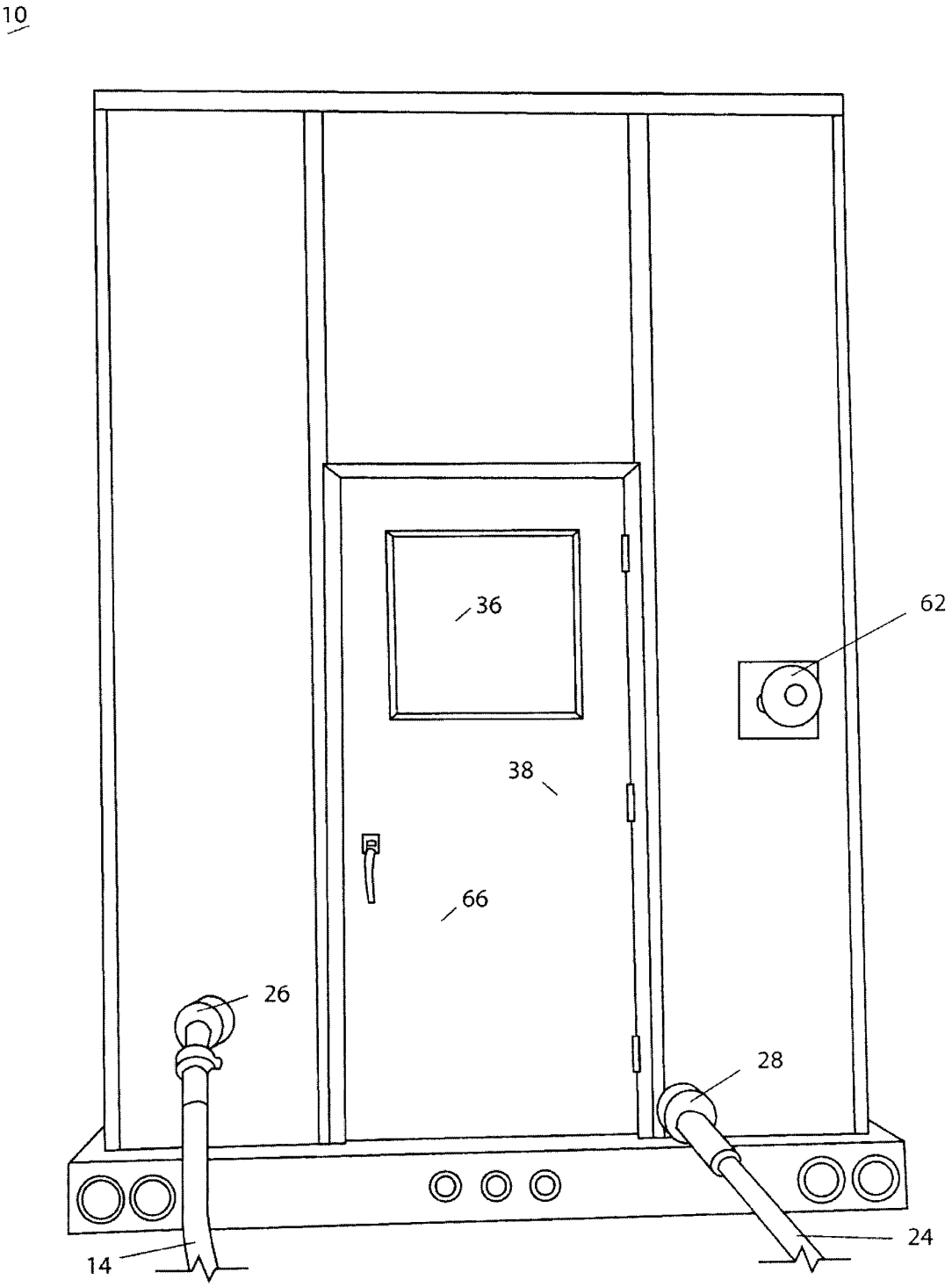
FIG. 4 is a rear elevation view of the embodiment of FIG. 3.

Referring to FIG. 4, an embodiment of apparatus 10 is shown from the rear. First flow line 14 for providing natural gas to apparatus 10 is shown as connected to inlet 26 to supply raw wet gas from source 12 to apparatus 10 to be processed. Third flow line 24 is shown as connected to outlet 28 to return processed/separated liquids from separator 16 back to the main flow line, or for storage or disposal. In some embodiments, apparatus 10 can also comprise a rear entry 66 for an operator to access gas separator 16.

Figure 5:
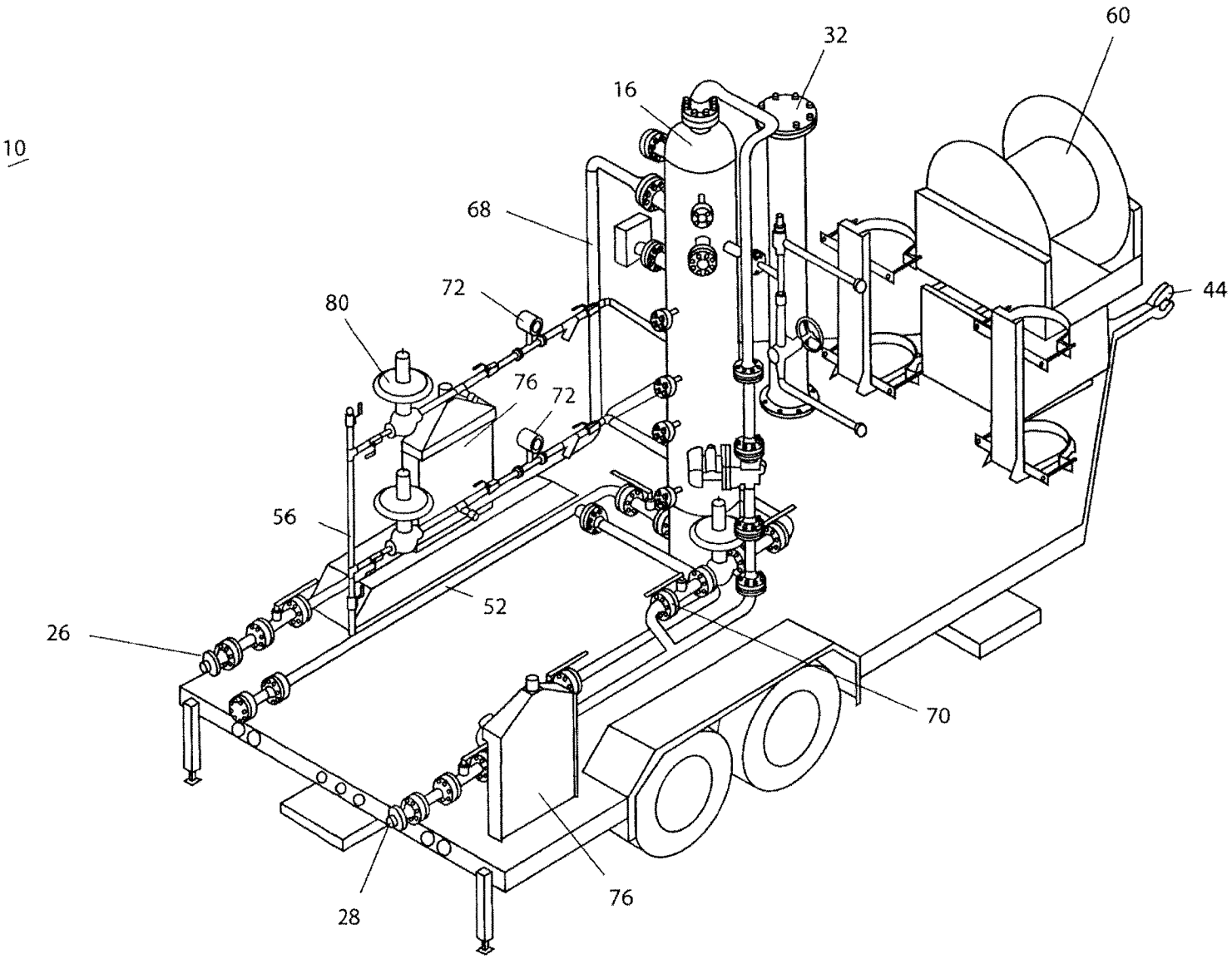
FIG. 5 is a cut away perspective view of an embodiment of an apparatus for supplying dried or conditioned natural gas to an apparatus for heating a fluid.

Referring to FIG. 5, the internal components of an embodiment of apparatus 10 is shown. A raw product line 68 can deliver raw wet gas from inlet 26 to separator 16 to be separated. As the fluids are being separated, combined fluid drain line 52, water drain 56, and outlet 28 can transfer fluids while the separated natural gas can move to dryer/conditioner 32 to be further processed. In some embodiments, a dump valve or drain valve 80 can be used to control drainage. A quaternary outlet 70 can provide the separated natural gas from separator 16 to dryer/conditioner 32 though secondary line 20, then onto hose reel 60 and ultimately to burner 18 to heat fracing fluid 22. In some embodiments, secondary line 20 can be a two inch diameter supply line to dryer/conditioner 32 from a three inch diameter vertical gas leg which could also be called a fuel gas leg or fuel gas supply line.

In some embodiments, dryer/conditioner 32 can be an eight inch diameter secondary separator/dryer/conditioner and could be vertical or horizontal, in some cases called a fuel gas scrubber, a desiccant dryer, a natural gas dryer, a natural gas separator, and/or a fuel gas separator.

In some embodiments, fluid measurement devices 72 can be placed along the lines to measure and/or quantify the fluids within.

Figure 6:
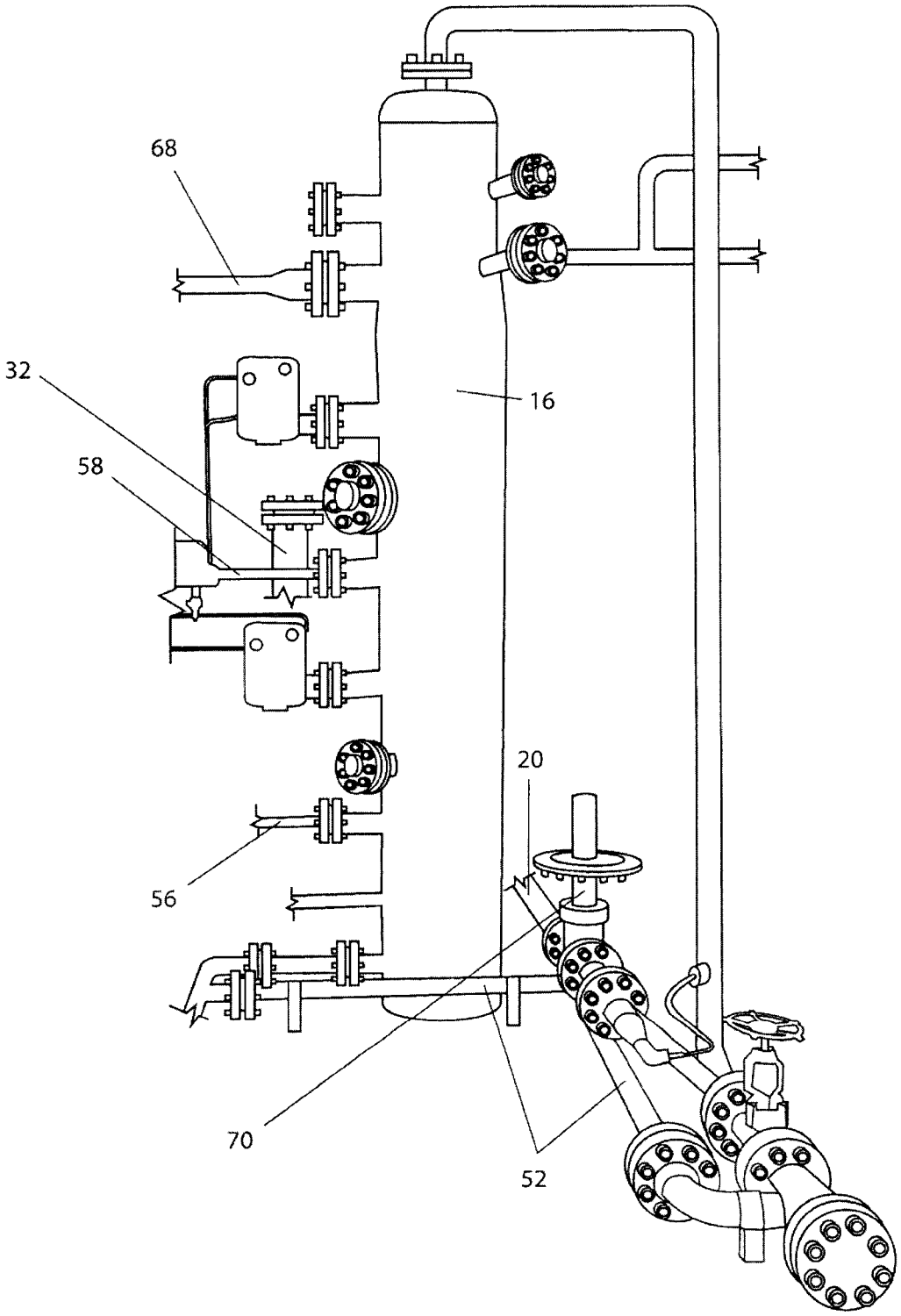
FIG. 6 is a close-up perspective view of an embodiment of an apparatus for supplying dried or conditioned natural gas to an apparatus for heating a fluid.
Figure 7:
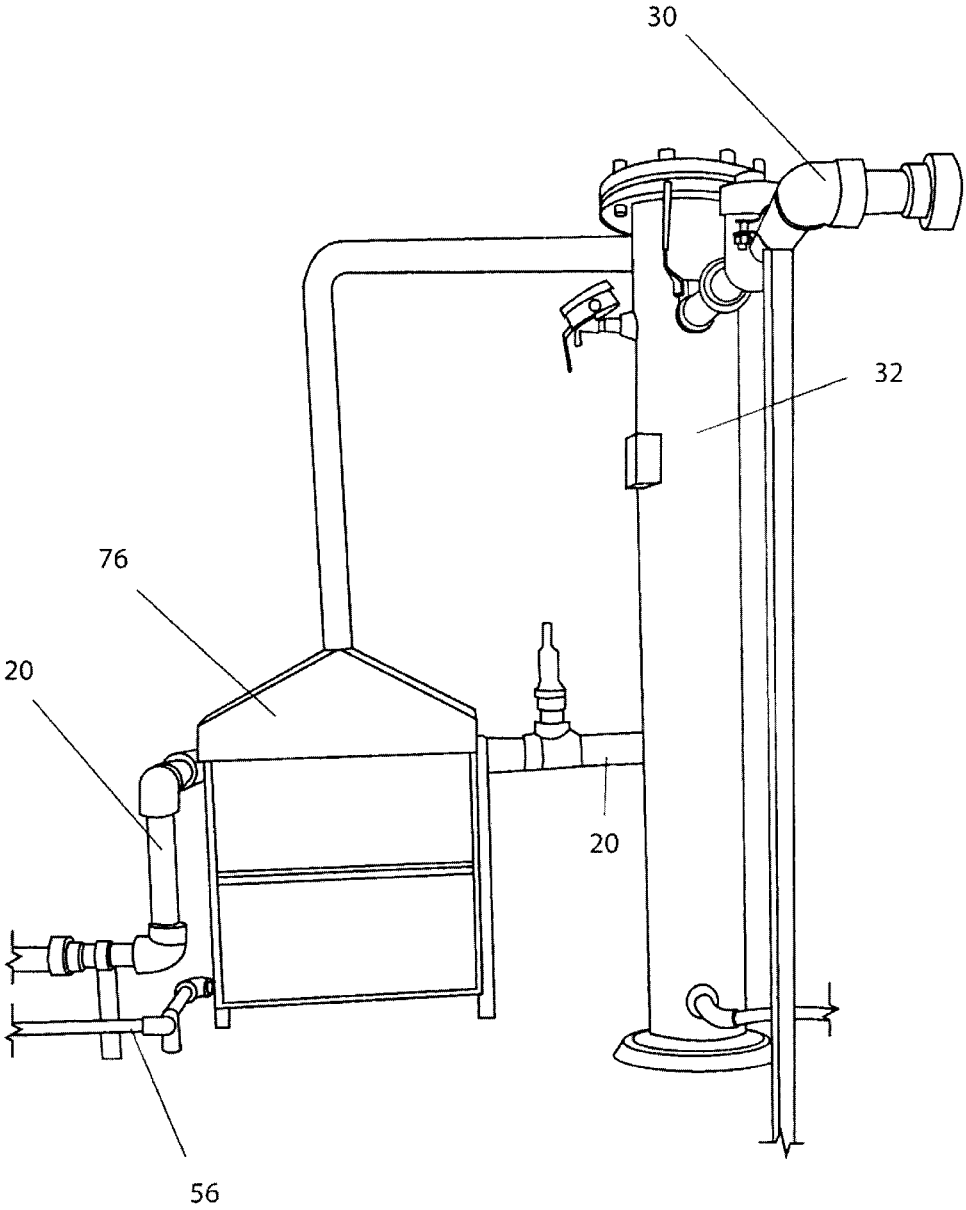
FIG. 7 is a close-up perspective view of an embodiment of an apparatus for supplying dried or conditioned natural gas to an apparatus for heating a fluid.

Referring to FIGS. 6 and 7, the internal components of an embodiment of apparatus 10 are shown in a cut-away manner. In FIG. 6, separator 16 is viewed from the rear entry 66. Natural gas can be processed while fluids are drained away at 56 and 58. The separated natural gas can then enter quaternary valve 70 and be supplied to dryer/conditioner 32 by secondary line 20 for further processing. In FIG. 7, dryer/conditioner 32 is viewed from the front entry 64. Secondary line 20 can be seen supplying the separated natural gas to dryer/conditioner 32. After being dried or conditioned in dryer/conditioner 32, the separated, dried natural gas can then be supplied through dry/conditioned gas outlet 30 to second flow line 20 and downstream applications, for example, supplying dry or conditioned natural gas to a burner system on a frac water heater.

In some embodiments, apparatus 10 can comprise additional features. Regarding the exterior, apparatus 10 can include insulated, walls, floor and roof, a smooth exterior finish, spray-on rock guard chip-protection trailer front wall (half way up from floor to wall midpoint). In addition, entries can be lockable and located at rear, passenger or drivers side. At the rear exterior bottom, apparatus 10 can comprise inlet and outlet ports, a bumper mounted drip tray and square tubing provision to mount a 2" chain vise.

In some embodiments, apparatus 10 can also include good/smooth trailer suspension, tandem axle sizing to enable apparatus 10 to accommodate 50% road bans, pipe racks to accommodate 2"×15' lengths, drivers side fitting/tool boxes with hinged doors, a Catadyne™ 12V hook up provision to power the Catadyne™, for example from a truck/vehicle battery, and/or a flow measurement device, for example a FloBoss™ 104, which can comprise a nine pin connector for connecting to a laptop.

Regarding the interior, in some embodiments, apparatus 10 can also include a vertical three-phase separator, for example a low profile separator (ground to top of gas leg 12'), a 1" globe valve separator blow down provision to discharge at roof height passenger side, a 1" fuel gas tie in downstream of meter run to Big Joe™ regulator and 8" fuel gas scrubber, secondary LPG fuel gas source from two 100# LPG tanks tied in to fuel gas system common with meter run fuel gas with accommodating check and isolation valves, LPG fuel gas hose reel provision (tie into secondary F/G source ie. 1000 gal LPG tank on lease site), two 24"×24" LPG 12V Catadyne™ heaters mounted as close to floor as possible; a natural gas fuel supply 78 from separator package 16 to heaters 76 and pneumatic instruments which can control fluid levels in apparatus 10; and/or a knowledge box with storage provision.

Regarding the piping, in some embodiments, apparatus 10 can also include certain components and specifications such as sour low temp, sch 80, 600 ANSI, fig 200 or 206 hammer unions, inlet/outlet building exterior 2" fig 200 or 206 hammer union×3" conc reducer to 3"600 flange to 3" inlet piping, directive 17 compliant sampling provisions on gas, condensation and water leg; and/or piping mounted well off floor approximately 12" floor to pipe centre (housekeeping).

In operation, natural gas can be supplied by an on-site source 12 and can supply gas as a fuel through a line to be processed, separated, dried and/or conditioned (in some embodiments) before being supplied to a heating unit to be burned by the heating unit's burner 18 and thereby heating fracing fluid 22 so that it can obtain or maintain an appropriate and/or predetermined temperature for fracing applications, avoiding freezing, and/or mitigating issues from the formation of paraffin by conditioning, softening, or managing formation of paraffin during the well fracturing process.

On-site natural gas can be processed by a separator 16 in order to prepare the natural gas for use as a fuel. In some embodiments, the separated natural gas can be dried or conditioned by a dryer/conditioner 32 so that it can be used as a more efficient fuel. As the natural gas is separated and dried or conditioned, the fluids can be drained to be returned to the main line or stored or disposed of.

The scope of the claims should not be limited by the embodiments as set forth in the examples herein, but should be given the broadest interpretation consistent with the description as a whole.

Although a few embodiments have been shown and described, it will be appreciated by those skilled in the art that various changes and modifications can be made to the embodiments described herein. The terms and expressions used in the above description have been used herein as terms of description and not of limitation, and there is no intention in the use of such terms and expressions of excluding equivalents of the features shown and described or portions thereof, it being recognized that the invention is defined and limited only by the claims that follow.

While the above description details certain embodiments of the invention and describes certain embodiments, no matter how detailed the above appears in text, the invention can be practiced in many ways. Details of the apparatuses and methods may vary considerably in their implementation details, while still being encompassed by the invention disclosed herein. These and other changes can be made to the invention in light of the above description.

Particular terminology used when describing certain features or aspects of the invention should not be taken to imply that the terminology is being redefined herein to be restricted to any specific characteristics, features, or aspects of the invention with which that terminology is associated. In general, the terms used in the following claims should not be construed to limit the invention to the specific embodiments disclosed in the specification. Accordingly, the actual scope of the invention encompasses not only the disclosed embodiments, but also all equivalent ways of practicing or implementing the invention.

The above description of the embodiments of the invention is not intended to be exhaustive or to limit the invention to the precise form disclosed above or to the particular field of usage mentioned in this disclosure. While specific embodiments of, and examples for, the invention are described above for illustrative purposes, various equivalent modifications are possible within the scope of the invention, as those skilled in the relevant art will recognize. The elements and acts of the various embodiments described above can be combined to provide further embodiments.

While certain aspects of the invention are presented below in certain claim forms, the inventors contemplate the various aspects of the invention in any number of claim forms. Accordingly, the inventors reserve the right to add additional claims after filing the application to pursue such additional claim forms for other aspects of the invention.

I claim:

1. An apparatus for separating a conditioning natural gas to produce a fuel source for a burner operative to heat a fluid stored on a site, the apparatus comprising:

a separator, having an inlet for receiving unprocessed natural gas directly from a natural gas source on the site, and an outlet, the separator for separating fluids from the natural gas, a conditioner, in-line with the separator, the conditioner having an inlet for receiving the separated gas from the outlet of the separator, and having an outlet for supplying the conditioned gas from the conditioner to the burner, the conditioner being an eight inch diameter conditioner configured to condition and dry the separated gas prior to supplying the conditioned gas directly to the burner, and a quaternary valve, in-line with the outlet of the separator and the inlet of the conditioner, for controlling the supply of the separated natural gas from the separator to the conditioner for conditioning, the separator, the quaternary valve, and the conditioner configured in-line to provide continuous and uninterrupted production of the fuel source.

2. The apparatus of claim 1 wherein the apparatus is configured to be mobile.

3. The apparatus of claim 1 wherein the separator is a separator package.

4. The apparatus of claim 1 further comprising an enclosure to enclose the separator.

5. The apparatus of claim 4 wherein the enclosure defines an entry way for an operator to access the separator.

6. The apparatus of claim 1 further comprising an electronics system connection in communication with the separator, the electronics system configured to operate the separator.

7. The apparatus of claim 6 wherein the electronics system is selected from the group consisting of a knowledge box, laptop, tablet, smart phone, and measuring devices.

8. A method of separating and conditioning natural gas to produce a fuel source for a burner operative to heat a fluid stored on a site, the method comprising:

providing unprocessed natural gas from a natural gas source on the site directly to a separator on the site;

processing the natural gas in the separator to create separated natural gas;

providing the separated natural gas from the separator through a quaternary valve to an eight inch diameter secondary conditioner for conditioning and drying the natural gas in the conditioner to create conditioned and dried natural gas;

providing the conditioned and dried natural gas to a burner on the site;

igniting the burner;

fueling the burner with the conditioned and dried natural gas to produce heat; and using the produced heat to heat the stored fluid on the site.

9. The method of claim 8 wherein the step of separating the natural gas comprises draining liquids from the natural gas.

10. The method of claim 9 further comprising the step of returning the liquids separated from the natural gas during the separation step to a return flow line for storage or disposal.

11. The method of claim 8 further comprising the step of heating the fluid stored on the site to a predetermined temperature.

12. A heating system for heating a fluid stored on a site, the system comprising:

the apparatus of claim 1 directly in-line with the natural gas source on the site and the burner for heating the fluid stored on the site.

13. The system of claim 12 further comprising a fluid storage tank or containment for storing the fluid stored on the site, the fluid storage tank attached to a frac water heater through lines or hoses.

14. The system of claim 12 wherein the system is configured to be fluidly continuous and uninterrupted.

* * * * *